United States Patent [19]

Nilsson et al.

[11] 3,932,904

[45] Jan. 20, 1976

[54] COMBINATION TOOL

[75] Inventors: Rune Nilsson, Lindesberg; Ake Jansson, Orebro, both of Sweden

[73] Assignee: United Shoe Machinery Company AB, Orebro, Sweden

[22] Filed: Feb. 27, 1975

[21] Appl. No.: 553,645

Related U.S. Application Data

[63] Continuation of Ser. No. 408,574, Oct. 23, 1973, abandoned.

[30] Foreign Application Priority Data

Oct. 27, 1972 Sweden ..... 13908/72

[52] U.S. Cl. ..... 7/14.1 R; 81/57.11

[51] Int. Cl.[2] ..... B25F 1/00; B26B 11/00

[58] Field of Search ..... 7/14.1 R; 81/52.4 R, 57.11; 285/316

[56] References Cited

UNITED STATES PATENTS

| | | | |
|---|---|---|---|
| 3,265,408 | 8/1966 | Dickie | 285/316 |
| 3,289,290 | 12/1966 | Sandor | 7/14.1 |
| 3,336,611 | 8/1967 | Schepp | 7/14.1 |
| 3,351,363 | 11/1967 | Downey et al. | 285/316 |
| 3,667,250 | 6/1972 | Schnepel | 81/52.4 R |

*Primary Examiner*—James L. Jones, Jr.

*Attorney, Agent, or Firm*—Pierce, Scheffler & Parker

[57] ABSTRACT

The present invention concerns a combination tool for providing a bore in a workpiece and for introducing a fastener, especially a self-threading screw, into said bore. Said combination tool comprises a cylindrical core one end of which is provided with a stub shaft meant to be connected to a drive means and the other end of which carries a mounting member for a drill. A sleeve surrounds said core and carries a tightening member for said screw. Said sleeve is axially displaceable along said core from a first end position in which said drill protrudes through and outside of said tightening member into a second end position in which the drill is completely retracted inside of same. In said first end position the sleeve is rotatable relative to said core, but in said second end position it is stationary thereto both with respect to rotation and to axial displacement.

5 Claims, 6 Drawing Figures

COMBINATION TOOL

This is a continuation, of application Ser. No. 408,574 filed Oct. 23, 1973, now abandoned.

The present invention concerns a combination tool for providing a bore in a work piece and for introducing a fastener, preferably a self-threading screw, into said bore.

A workman occupied in erecting work in which self-threading screws are used has up to now been forced first to drill the holes, for instance by means of an electric drilling machine and thereafter to exchange the drill in the machine for a tool for screwing in said screws. It is of course also possible to use two machines, a drilling machine and a machine for tightening of the screws, but both methods involve considerable costs.

The object of the present invention is to provide a combination tool by means of which it is possible rapidly and alternatedly to effect said two work operations without change of the tools or machines. The erecting work thereby becomes much cheaper and can be done much faster.

Another object of the invention is to construct the combination tool in such a way that the tightening of the self-threading screw is carried out with a predetermined moment, so that the screws are tightened with the same moment and all risks for overstresses and breakage of a screw are eliminated.

The intention is finally that the combination tool of the invention shall be useable with machines usually present at the work place so that the investment costs become low.

The above stated objects of the present invention are achieved by means of a combination tool having a construction as stated in the attached claims.

Figure 1:
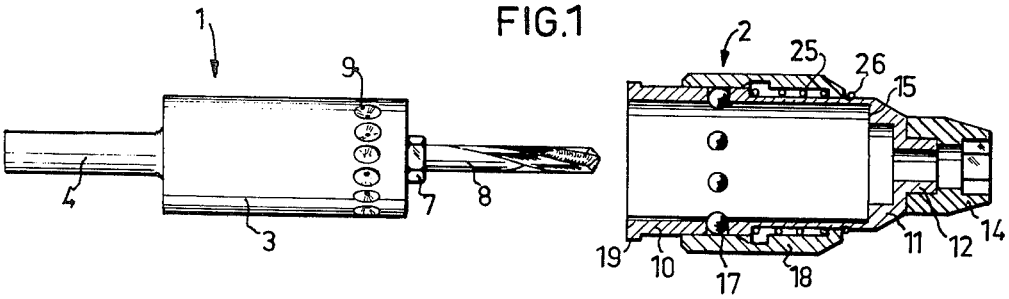
Figure 5:
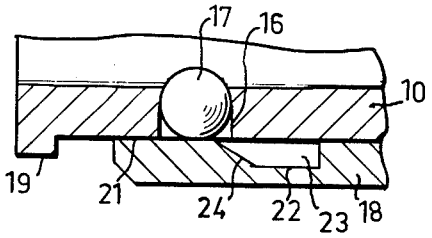
Figure 6:
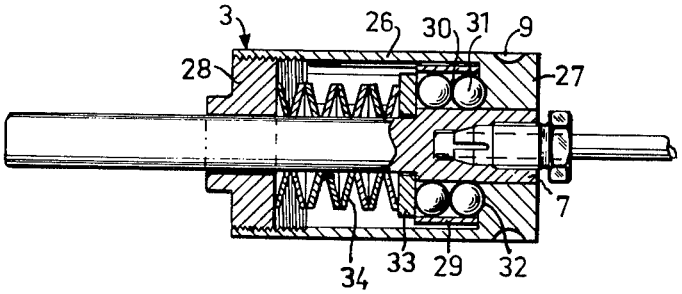
Figure 2:
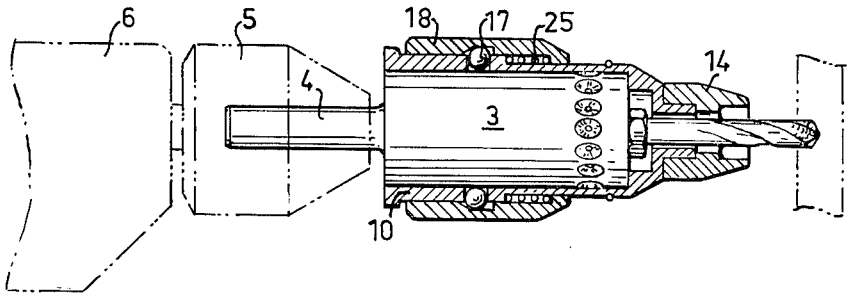
Figure 3:
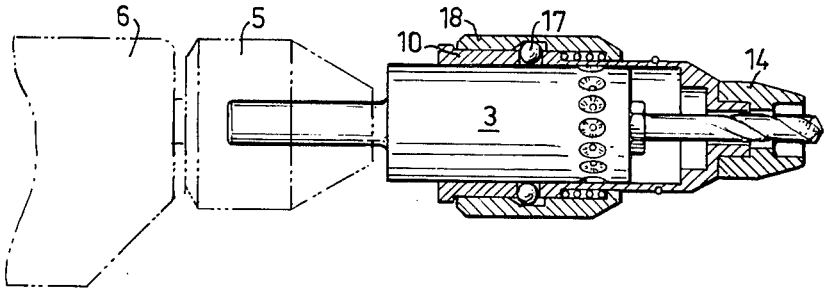
Figure 4:
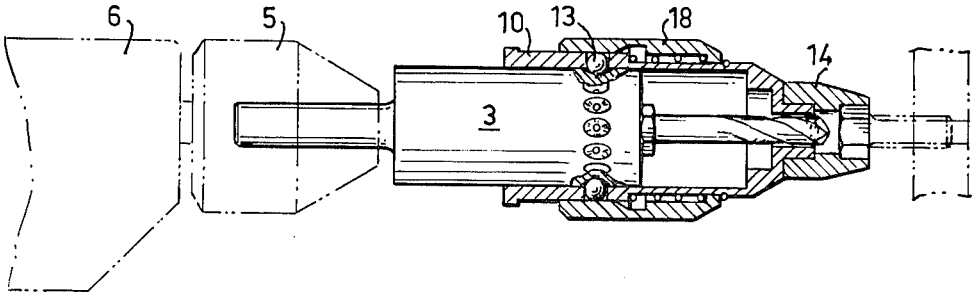

An embodiment of the invention will now be described with reference to the attached drawing, on which FIG. 1 is an exploded elevation of a combination tool according to the invention, partly in axial section, FIG. 2 is an elevation, partly in axial section, of the tool arranged in a drilling machine and in a position for drilling, FIG. 3 is a view corresponding to FIG. 2 during switch-over between its two working positions, FIG. 4 is a corresponding view, showing the tool in its position for tightening a screw, FIG. 5 is an axial section of a part of the tool and FIG. 6 is an axial section of another part of the tool according to the invention.

The combination tool according to the invention comprises an inner portion, called the core 1 in the following description, and an outer portion 2.

Said core is formed by a cylindrical body 3 which at one end thereof is provided with a central stub axle 4 to be attached to a driving device, i.e., the chuck 5 of a conventional drilling machine 6. The other end of the body 3 is provided with a central mounting member 7 for a drill 8. Said mounting member 7 may have any suitable construction and since it does not form any part of the present invention it will not be further described. The cylindrical outer surface of said core body 3 is furthermore provided with a number of part spherical depressions 9 which are arranged peripherally around said body in a plane perpendicular to the axis thereof.

The outer portion 2 of the tool comprises a cylindrical sleeve 10 having such an internal diameter that it has easy running fit on the cylindrical core body 3. The front end 11 of the sleeve 10 has a conical taper and merges with a central peg 12 to which is replaceably fastened a tightening member 14 fitting the screw to be used. The peg 12 may have an arbitrary form suitable to accommodate a tightening member in a replaceable manner and may thus be cylindrical and threaded so as to be screwable into the tightening member or non-circular and provided with a suitable snap lock, such as a ball snap lock.

The through bore of the sleeve 10 comprises a main portion having greater diameter and meant to surround the core body 3 under easy running fit and an end portion having a smaller diameter and meant to accommodate said drill 8 with a comparatively great clearance. Said end portion is aligned with a corresponding bore in the tightening member 14 so that said drill 8 during the drilling operation may protrude a suitable distance outside of said tightening member 14. A radial shoulder 15 forms a connection between said bore portions of greater and smaller diameters and cooperates with the adjacent end of the core body 3 in forming a stop member for one end portion of said sleeve 10.

A number of radial through bores 16 are arranged in the wall of the sleeve 10 and have the same spacing as said depressions 9 of the core body 3 or a multiple thereof. Said through bores 16 accommodate balls 17 the diameters of which are somewhat greater than the wall thickness of the sleeve. The openings of the through bores 16 in the inner wall of the sleeve 10 are preferably restricted to some degree so that said balls 17 may not fall inwards but may partly extend into the inner space of said sleeve 10.

A locking member 18 in the form of a ring or a cylindrical bushing surrounds said sleeve 10 and is both axially displaceable and rotatable relative to same. The axial displacement of the locking member 18 is restricted in one direction by abutment between one of its edges and an annular flange 19 at the end of the sleeve 10 spaced from the tightening member 14, and displacement of the locking member 18 in the opposite direction is restricted by abutment between the other edge of the locking member and circlip 26, arranged in an annular groove in the outer surface of the sleeve 10 at some distance from the conical end thereof.

The internal cylindrical surface of said locking member 18 comprises at least one annular surface portion 21 which engages the outer cylindrical surface of the core body 3, and one annular surface portion 22 situated at a distance outside of said outer cylindrical surface (see FIG. 5). The last mentioned surface portion is preferably provided by the bottom surface of an annular groove 23 arranged in the inner surface of said locking member 18. Said annular groove 23 is placed in said locking member 18 in such a way that its medium plane coincides with the plane through the centres of said balls 17, when said locking member 18 is displaced into abutment against the annular flange 19 of said sleeve. In this position said balls 17 can be moved radially outwards into said annular groove 23 into engagement with the bottom surface 22 thereof. The sum of the thickness of the ball of the sleeve 10 and the depth of the annular groove 23 is at least equal to the diameter of said balls so that same, when engaging the bottom surface 22 of said annular groove 23, are situated fully outside of the bore of the sleeve 10, said sleeve 10 together with the locking member 18 then being axially displaceable and rotatable relative to the core body 3.

When the locking member 18 is moved away from its engagement with the annular flange 19 the annular groove 23 is also moved out of alignment with the balls 17 and the balls roll over the edge surface 24 of the annular groove, which is chamfered on this side, up onto the surface portion 21 and are thereby forced partly to extend into the inner space of the sleeve. A compression spring 25 is tensioned between an outer shoulder of the sleeve 10 and an inner shoulder of the locking member 18 and tends to displace the latter in the direction of said circlip 26.

Finally the sleeve 10 is axially displaceable relative to the core body 3 from an end position, in which said body 3 engages the internal shoulder 15 of the sleeve 10 and the drill 8 protrudes outside of the tightening member 14 far enough to enable the drilling of the hole of sufficient depth for the intended screw, to a second end position, in which said balls 17 engage into said part spherical depressions 9 of the core body 3. In said second end position the drill 8 is completely retracted into the sleeve 10 and the tightening member 14 may without obstruction be applied on the screw to be tightened.

The adjustment of the combination tool between these end positions will now be described starting from the first of said end positions which is shown in FIG. 2.

In this end position the outer portion 2 is situated in engagement with the shoulder 15 against the core body 3. The outer portion 2 is retained in this position by means of the friction between the steel balls 17 and the core body 3 on account of the radial pressure on the balls 17, which is generated by the locking member 18 being pressed forwards by means of the pressure spring 25, which fact on account of the chamfer 24 of the groove 23 causes a radial pressure on the locking balls. The drill 8 protrudes outside of the tightening member 14 and when the drilling machine 6 is started the desired hole can be drilled and the drill can thereby be guided by the workman gripping the locking member 18 which together with the sleeve 10 is freely rotatable around the core body 3. When the drilling is completed the workman pushes the locking member 18 forwards and the balls 17 then carry the sleeve 10 along, since they are prevented from displacement inwardly by the core body 3, so that the coupling is maintained in axial direction between said locking member 18 and said sleeve 10. When said balls 17 are situated opposite to the depressions 9 in the cylindrical outer surface of the core body 3, movement of the balls 17 radially inwards is, however, possible so that said balls are cammed into said depressions by the chamfered edge side 25 of the annular groove 23. The balls 17 are thereby pushed so far inwards that they to their full extent are situated inside of the outer surface of the sleeve 10 and the locking member 18 can then be displaced axially relative to said sleeve 10 into engagement with the circlip 26 under the action of the adjusting force and the force from the spring 25. In this position the internal surface portion 21 of the locking member 18 retains the balls 17 in their position of engagement into the depressions 9 and the sleeve is thereby held immovable both against axial movement and rotation relative to the core body 3, the tightening member 14 being situated far enough outside of the tip of the drill 8 to allow application thereof over a screw head (see FIG. 4) to tighten said screw.

When the tool is adjusted to the position for a new drilling operation, the workman pulls the locking member 18 in the opposite direction, the locking member then being displaced axially in respect to the sleeve 10 under tensioning of said spring 25 until the annular groove 23 is brought to a position opposite said balls 17. The bottoms of said depressions 9 then act as cam surfaces and force said balls 17 radially outwards into said annular groove 23, whereby the connection between said sleeve 10 and said core body 3 is disconnected and the sleeve 10 together with the locking member 18 is axially movable backwards into engagement with the shoulder 15 (see FIG. 2).

It should be pointed out that the locking member 18 in all positions is freely rotatable either by itself or together with the sleeve 10, wherefore the drilling machine 6 need not be stopped when the tool is adjusted. If the locking member 18 is pulled back from the tightening position according to FIG. 4 against the action of the spring 25 and the sleeve 10 at the same time is retained in its position, the annular groove 23 is drawn into the position opposite the balls 17 and said sleeve with the members arranged thereon can thereafter be pushed forwards, whereby the balls 17 are pressed radially outwards and the outer portion 2 of the tool can thereafter be removed from the inner portion 1 (see FIG. 1). Thus it is very simple to exchange drills and keep the tool free from drill chips.

It should also be pointed out that even if the described embodiment contains several balls 17, one single ball may be sufficient in certain cases.

The inner portion or core 1 of the tool may be formed by a single, solid piece of material, but the invention also embraces an embodiment in which the tightening member 14 is driven over a moment limiting slip clutch as is shown in FIG. 6.

The core body 3 then consists of a hollow cylinder 26 having an integral bottom wall 27 at one end and second bottom wall 28 which can be screwed into the other end of the cylinder. The stub shaft 4 and the mounting member 7 for the drill 8 are formed as an integral member and are journalled for rotation in central openings in said bottom walls 27, 28. Adjacent the internal side of the integral bottom wall 27 said stub shaft 4 is provided with an annular flange 29 having a smaller diameter than the internal diameter of said cylinder 26 and comprising a number of axial through bores 30. A pair of clutch balls 31 are arranged in each of said axial bores 30, the length of which is less than twice the diameters of said balls 31. A number of part spherical depressions 32, corresponding to the number of bores 30, are formed in the inner surface of the integral bottom wall 27 and are spaced to correspond to the bores 30. An annular pressure plate 33 surrounds said stub shaft 4 and is pressed against the clutch balls 31 facing the loose bottom wall 28 by means of a pressure spring or a package 34 of spring washers, which is arranged between said pressure plate 33 and said loose bottom wall 28.

When the tool is used for drilling, the moment of the drilling machine 6 is directly transferred to the drill 8. When screws are to be tightened, however, the moment is transferred to the tightening member 14 via the slip clutch 29–34 and when said moment becomes so great, that is can force the clutch balls 31 out of the depressions 32 against the action of the spring 34, the clutch slips. The force of said spring and thus the transferrable moment is adjustable by screwing the loose bottom wall 28 further into or out of said cylinder 26.

The combination tool described above has all the advantages mentioned in the introduction to the description and thus provides a cheap and useful means to simplify erecting work or the like by means of self-threading screws.

What we claim is:

1. A combination tool for providing a bore in a workpiece and for introducing a fastener, preferably a self-threading screw, into said bore, said tool comprising a. a cylindrical core having at one end a stud shaft adapted to be driven by a driving means and at the other end a central mounting member for a drill;

b. a first sleeve having at one end a tightening member, said first sleeve surrounding said core and being rotatable and axially displaceable relatively thereto;

c. a second sleeve surrouding said first sleeve and being rotatable and axially displaceable thereto; and d. coupling means which are axially displaceable together with said first sleeve, said coupling means being so arranged that i. in a first end position of said first sleeve in which said drill protrudes through and beyond said tightening members, and in a first end position of said second sleeve to connect said two sleeves for mutual axial displacement;

ii. upon such mutual axial displacement of said two sleeves into a second end position of said first sleeve in which said drill is completely retracted inside of said tightening member to release said connection between said two sleeves and to engage said core for unrotatable as well as axially undisplaceable connection of said first sleeve to said core; and iii. upon continued axial displacement of said second sleeve relatively to said first sleeve into a second end position of said second sleeve to lock said coupling means in said engagement.

2. A tool as defined in claim 1, wherein there is at least one radial through-bore in the wall of said first sleeve; and wherein a ball is accommodated in said through-bore said ball having a greater diameter than is the thickness of said sleeve wall; said tool being further characterized by a circumferential groove in the inner surface of said second sleeve;

the arrangement being such that said ball in the first end positions of said two sleeves is partly received in said circumferential groove in rolling engagement against the outer surface of said core, said ball in said second end positions of said two sleeves being partially received in a depression in the outer surface of said core and in rolling engagement with the inner surface of said second sleeve outside of said groove.

3. A tool as defined in claim 2, in which the trailing side surface of said groove, when said second sleeve is displaced from its first end position into its second end position, is chamfered to provide a cam action for shifting said ball out of said groove upon axial displacement of said second sleeve relatively to said first sleeve in the second end position thereof.

4. A tool as defined in claim 2, wherein the opening of said radial bore through the inner surface of said first sleeve is restricted to prevent the ball from balling out.

5. A tool as claimed in claim 1, characterized in that said mounting means for the drill is reigidly connected to said stub shaft and that a moment restricting slip clutch is arranged between said stub shaft and an envelope of the core.

* * * * *

UNITED STATES PATENT OFFICE

CERTIFICATE OF CORRECTION

PATENT NO. : 3,932,904

DATED : January 20, 1976

INVENTOR(S) : Rune Nilsson et al

It is certified that error appears in the above-identified patent and that said Letters Patent are hereby corrected as shown below:

In Claim 4 - line 3, "balling" should read "falling"

In Claim 5 - line 2, correct the spelling of "rigidly".

Signed and Sealed this

Twentieth Day of July 1976

[SEAL]

*Attest:*

RUTH C. MASON
*Attesting Officer*

C. MARSHALL DANN
*Commissioner of Patents and Trademarks*